US008540126B2

(12) United States Patent
Kawamoto et al.

(10) Patent No.: US 8,540,126 B2
(45) Date of Patent: Sep. 24, 2013

(54) GUN HOLSTER

(75) Inventors: Steven A. Kawamoto, Ann Arbor, MI (US); Richard M. Kawamoto, Divide, CO (US); James H. Lua, Columbus, OH (US)

(73) Assignee: Peregrine Outdoor Products, LLC, Lakeway, TX (US)

( * ) Notice: Subject to any disclaimer, the term of this patent is extended or adjusted under 35 U.S.C. 154(b) by 149 days.

(21) Appl. No.: 12/762,637

(22) Filed: Apr. 19, 2010

(65) Prior Publication Data

US 2010/0314423 A1 Dec. 16, 2010

Related U.S. Application Data

(60) Provisional application No. 61/170,153, filed on Apr. 17, 2009.

(51) Int. Cl.
*F41C 33/02* (2006.01)

(52) U.S. Cl.
USPC ..... 224/149

(58) Field of Classification Search
USPC ..... 224/149
See application file for complete search history.

(56) References Cited

U.S. PATENT DOCUMENTS

| | | | | |
|---|---|---|---|---|
| 476,246 A | | 6/1892 | Burgess | |
| 919,301 A | | 4/1909 | Anderson | |
| 2,423,531 A | | 7/1947 | Theis | 224/2 |
| 2,536,252 A | | 1/1951 | Bates | 224/2 |
| 2,543,703 A | | 2/1951 | Pelto | |
| 2,588,467 A | | 3/1952 | Barney | |
| 3,127,075 A | | 3/1964 | Yavello | |
| 3,422,497 A | | 1/1969 | Lyons | |
| 3,498,511 A | | 3/1970 | Marg | |
| 3,869,074 A | | 3/1975 | Roach | |
| 4,243,165 A | | 1/1981 | Schuler | 224/149 |
| D293,857 S | * | 1/1988 | Stout et al. | D3/229 |
| 4,718,585 A | * | 1/1988 | Atkins, Sr. | 224/238 |
| D300,989 S | * | 5/1989 | Kovach | D3/221 |
| 4,911,345 A | | 3/1990 | James et al. | |
| 4,961,523 A | * | 10/1990 | Stimac | 224/232 |
| 5,054,671 A | * | 10/1991 | Else | 224/192 |
| D325,300 S | | 4/1992 | Miklus, II | |
| D332,351 S | * | 1/1993 | Smith | D3/228 |
| 5,325,618 A | | 7/1994 | Turner | 42/85 |
| D368,366 S | * | 4/1996 | Cedarberg, III | D3/219 |
| 5,927,574 A | | 7/1999 | Ruesink | |
| 8,056,778 B1 | | 11/2011 | Michaux | 224/149 |

* cited by examiner

*Primary Examiner* — Justin Larson
(74) *Attorney, Agent, or Firm* — Blake P. Hart

(57) ABSTRACT

A holster for a long gun such as a shotgun or rifle that provides a safe firearm support and allows for quick aiming and firing of the firearm. Generally, the gun holster includes a base portion for securing to the user, such as to the user's belt, and a support portion for supporting the gun. The support portion includes a bottom wall portion that extends forwardly from a lower edge of the base portion. Several embodiments are disclosed. In some embodiments, the base portion and support portion are integrally formed of a folded fairly flexible material, such as leather.

16 Claims, 20 Drawing Sheets

GUN HOLSTER

This application claims priority to U.S. Provisional Application Ser. No. 61/170,153 filed Apr. 17, 2009.

BACKGROUND OF THE INVENTION

The present invention relates to a holster for a long gun such as a shotgun or rifle. More particularly, the holster provides a safe firearm support and allows for quick aiming and firing of the firearm.

When hunting out in the field, it can be disadvantageous to carry a firearm without any kind of support aids. Long guns such as shotguns and rifles tend to be heavy, and carrying them for hours at a time can be extremely tiresome. Furthermore, in situations that require one or both hands, it's often undesirable to set the gun down on the ground, especially if the ground is covered in snow or mud. To mitigate these issues, there exist a number of designs of shotgun holsters and slings. There are many designs that use complicated arrangements of straps to support the firearm. These cumbersome straps greatly reduce ease of operation, interfere with the user's ability to effectively fire the gun, and block access to jacket and vest pockets.

Another design teaches a strapless shotgun holster. In this design, the holster is supported only by the user's belt. However, the holster hangs down from the belt. This interferes with the movement of the user, especially with trying to high-step over obstacles. In addition, the torque created by the holster's hanging can be uncomfortable and can reduce the effectiveness of the holster in keeping the firearm upright.

SUMMARY

The present invention relates to a holster for a long gun such as a shotgun or rifle. More particularly, the holster provides a safe firearm support and allows for quick aiming and firing of the firearm.

Generally, the gun holster includes a base portion for securing to the user, such as to the user's belt, and a support portion for supporting the gun. The support portion includes a bottom wall portion that extends forwardly from a lower edge of the base portion.

Several embodiments are disclosed. In some embodiments, the base portion and support portion are integrally formed of a folded fairly flexible material, such as leather.

DETAILED DESCRIPTION OF THE PREFERRED EMBODIMENT

Figure 1:
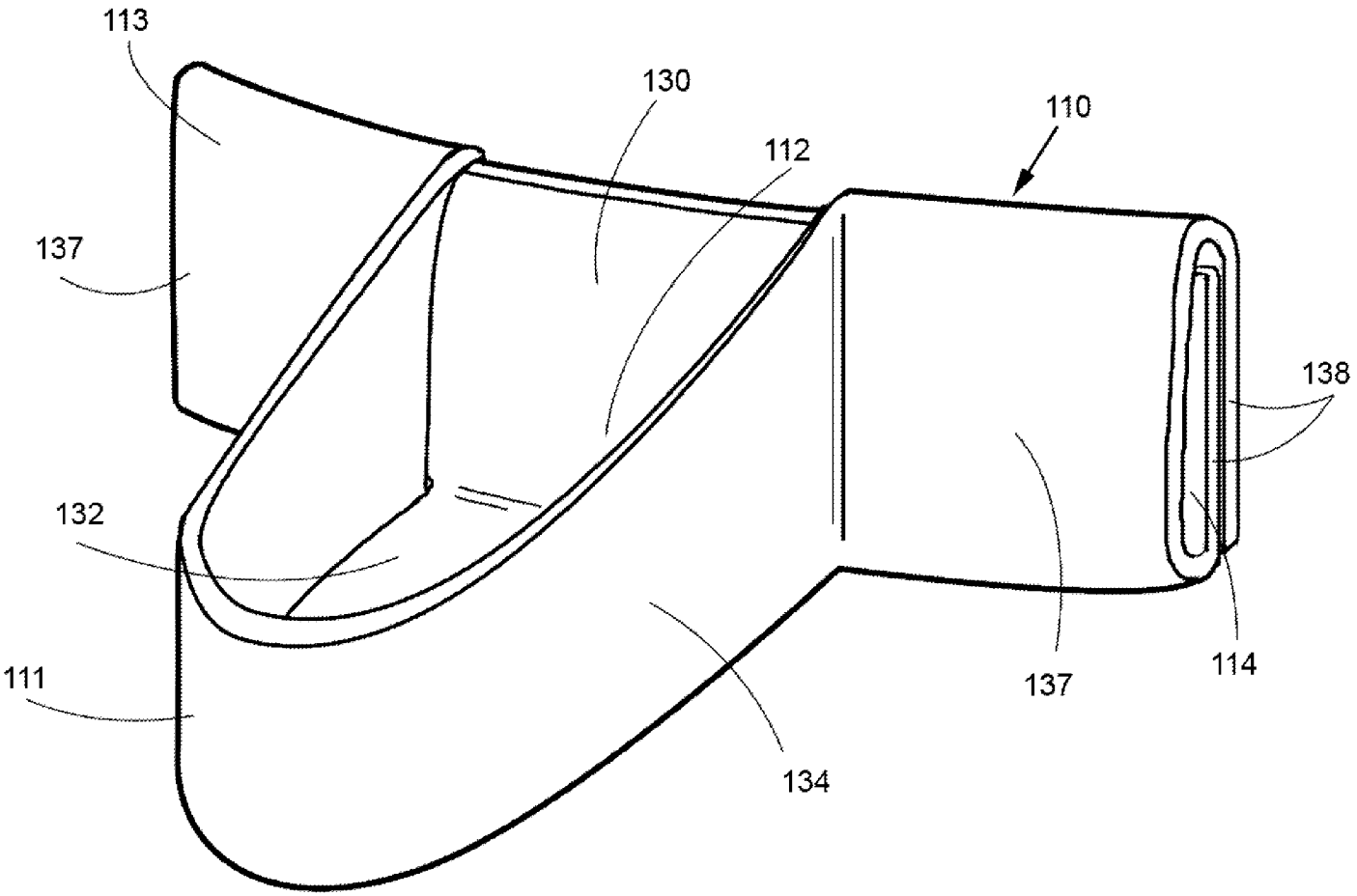
FIG. 1 is a front perspective view of a first example holster of the present invention.

FIG. 1 illustrates a first example holster 110. The holster 110 includes a support portion 111 having a cavity 112 for holding a butt of a firearm and a base portion 113 for securing to a user, such as to the user's belt. The cavity 112 is defined by a back section 130, a bottom section 132 and a side section 134, and an opening 114 through which a belt can be inserted. The opening 114 is formed by a back securing section 137 and a folding back securing section 138. The bottom section 132 extends from the bottom edge of the back section 130, such that the back section 130 is approximately on the level of the belt and the holster 110 does not hang below the belt.

Figure 2:
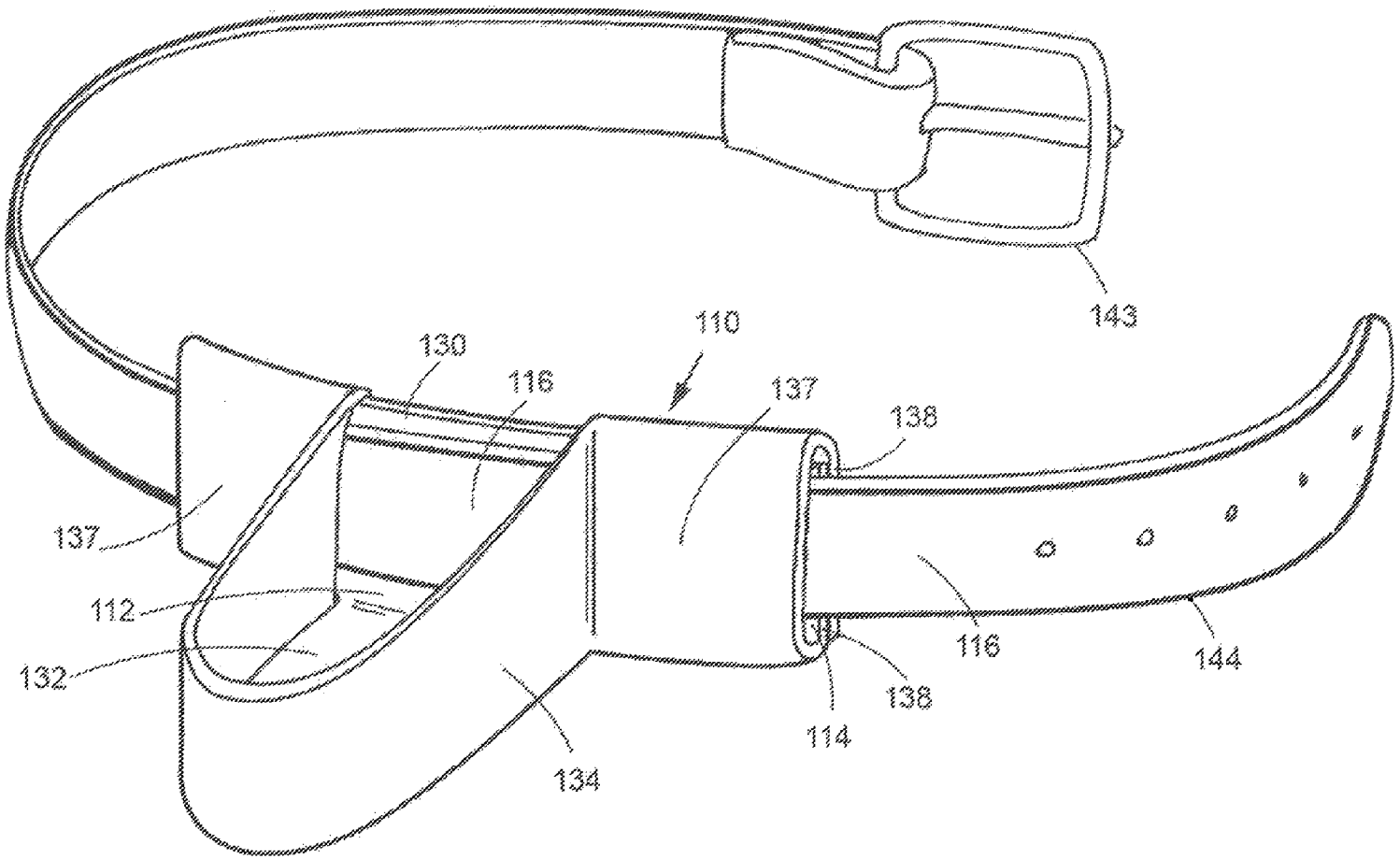
FIG. 2 illustrates the first example holster of the present invention attached to a belt.

FIG. 2 illustrates the first example holster 110 attached to a belt 116 having buckle 143 and strap 144. The holster 110 is worn on the belt 116 by inserting the strap 144 of belt 116 through the opening 114, in front of the back section 130 and behind back securing sections 137.

Figure 3:
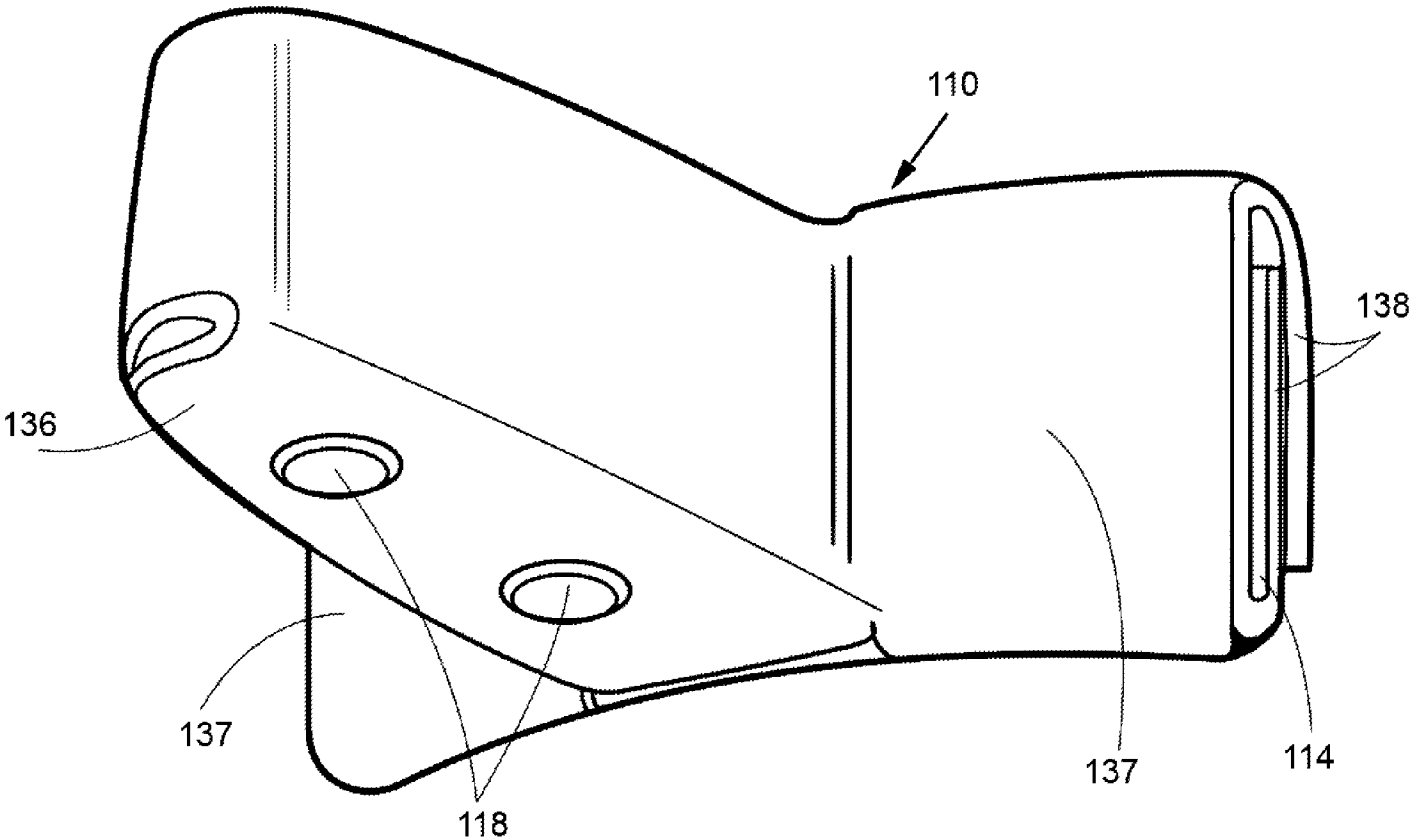
FIG. 3 is a bottom perspective view of the first example holster of the present invention.

FIG. 3 illustrates the bottom of the first example holster 110. The opening 114 is formed by a back securing section 137 and folding back securing sections 138. The bottom securing section 136 is continuous with the side section 134, and includes female connectors 118. The female connectors 118 are connecting devices such as snaps, clasps, buckles, etc., and hold the holster 110 together. Alternatively, the folding sections could be sewn together to form the holster.

Figure 4:
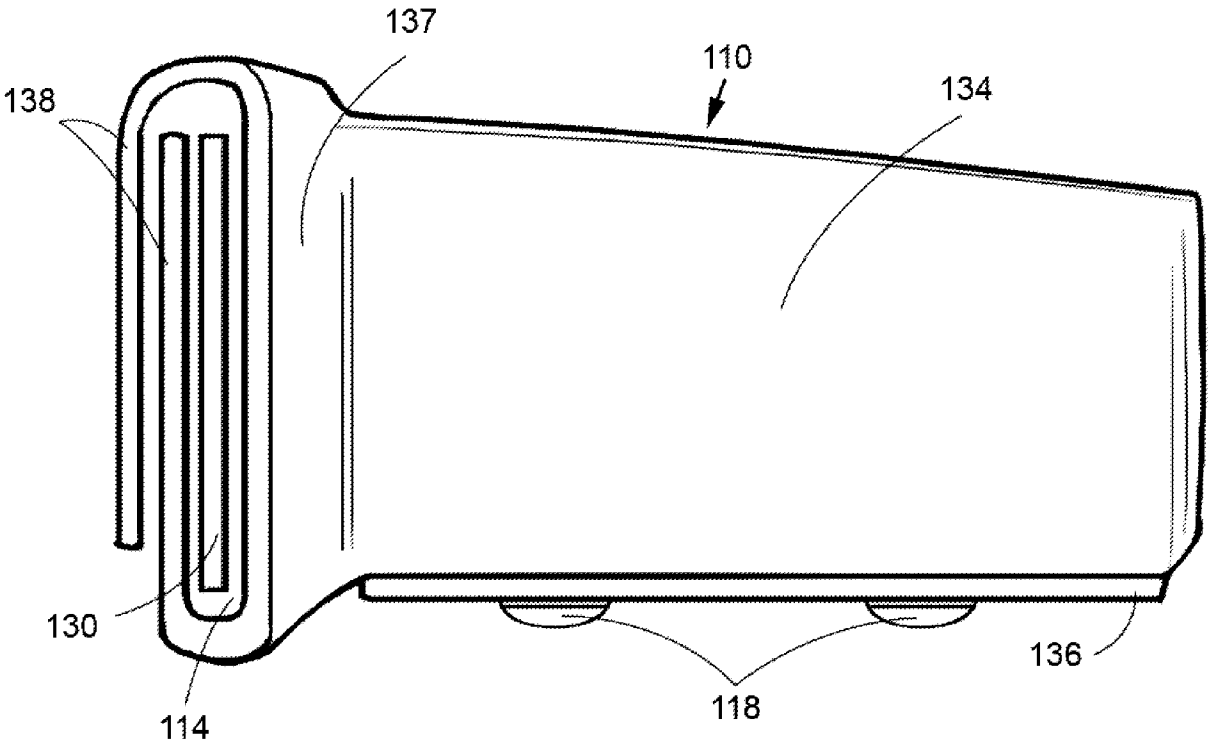
FIG. 4 is a side view of the first example holster of the present invention.

FIG. 4 illustrates the side of the first example holster 110. As shown, the back section 130 is between the back securing section 137 and the folding back securing sections 138. The opening 114 for receiving the belt is defined between the back section 130 and the back securing section 137.

Figure 5:
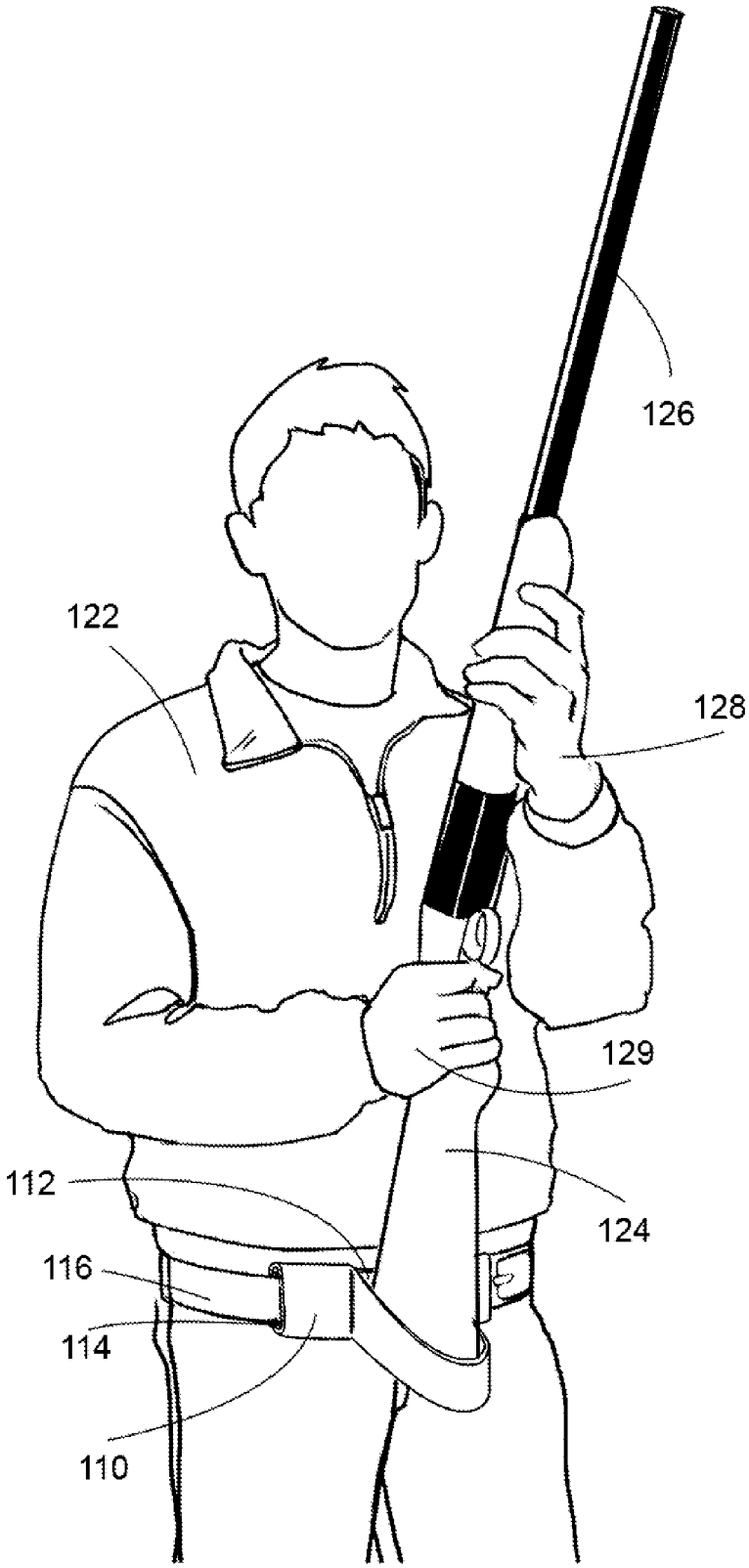
FIG. 5 illustrates the first example holster of the present invention in use with user, belt and firearm.

FIG. 5 illustrates the use of the first example holster 110. A butt 124 of a firearm 126 is received in the cavity 112 and a belt 116 is inserted through the opening 114. The holster 110 does not hang below the belt 116. The holster 110 is worn on the belt 116 of the user 122 by inserting the belt 116 through the opening 114 and the user 122 wearing the belt 116. The butt 124 of the firearm 126 rests in the cavity 112, keeping the firearm 126 in a safe upward position. One hand of the user 122, ideally the non-shooting hand 128, is required to hold the firearm 126 to keep the firearm 126 secured in the holster 110. The shooting hand 129 of the user 122 may also hold the firearm 126 to be ready for fast aiming and firing of the firearm 126. The weight of the firearm 126 is distributed by the holster 110 on the belt 116 of the user 122.

Figure 6:
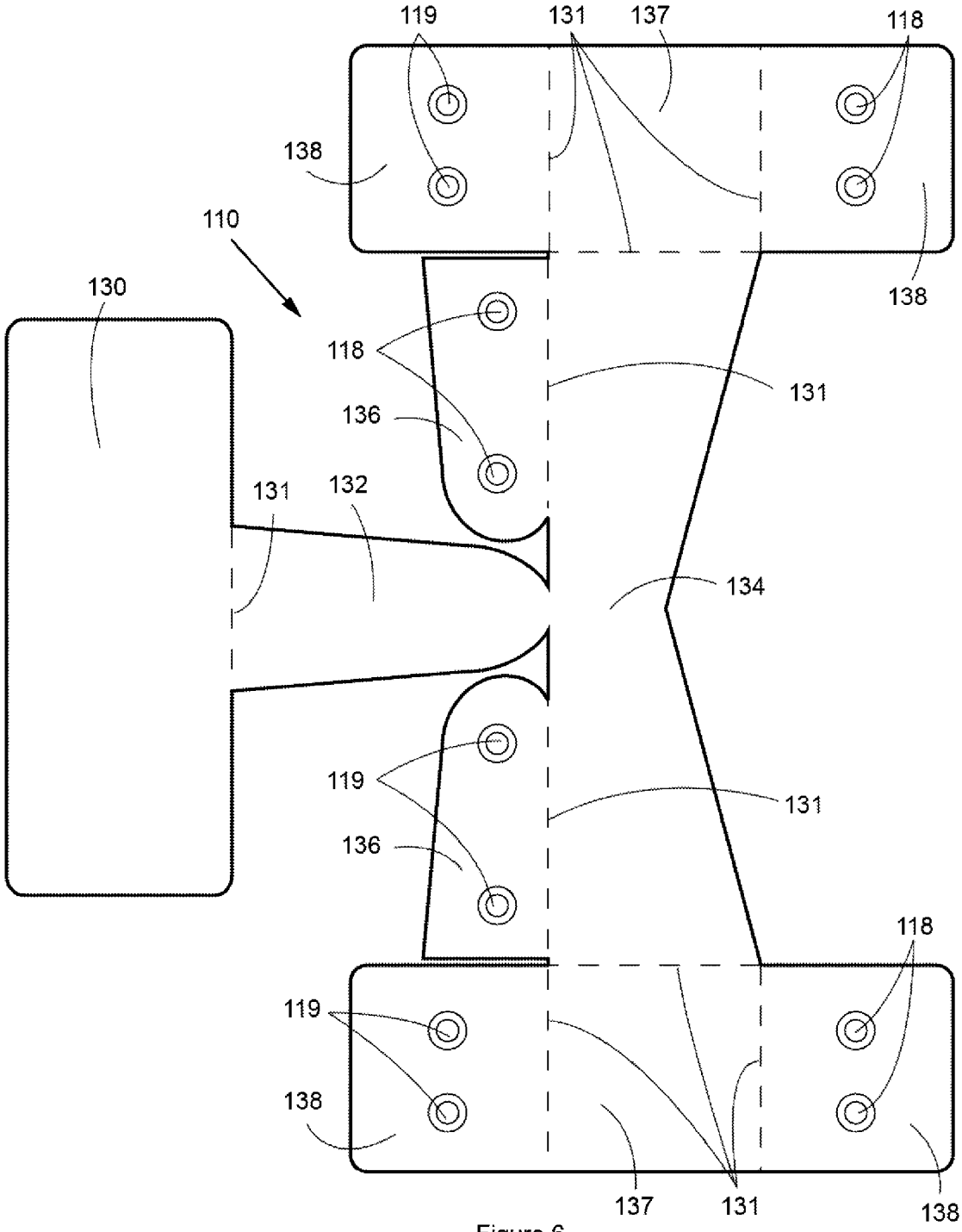
FIG. 6 is a disassembled view of the first example holster of the present invention.

FIG. 6 illustrates the disassembled first example holster 110. The holster 110 includes the back section 130, the bottom section 132, the side section 134, bottom securing sections 136, back securing sections 137, folding back securing sections 138, female connectors 118 and male connectors 119. The holster 110 is made from one piece of material, which can be leather, fabric, reinforced fabric, plastic, Cordura® etc. The holster 110 is folded along fold lines 131, and held together using the female connectors 118 and male connectors 119. Though one example configuration of female connectors 118 and male connectors 119 is shown (i.e. snaps), various configurations are possible, including rivets, hook and loop, adhesives, thread, etc, as may be apparent to one skilled in the art.

Figure 7:
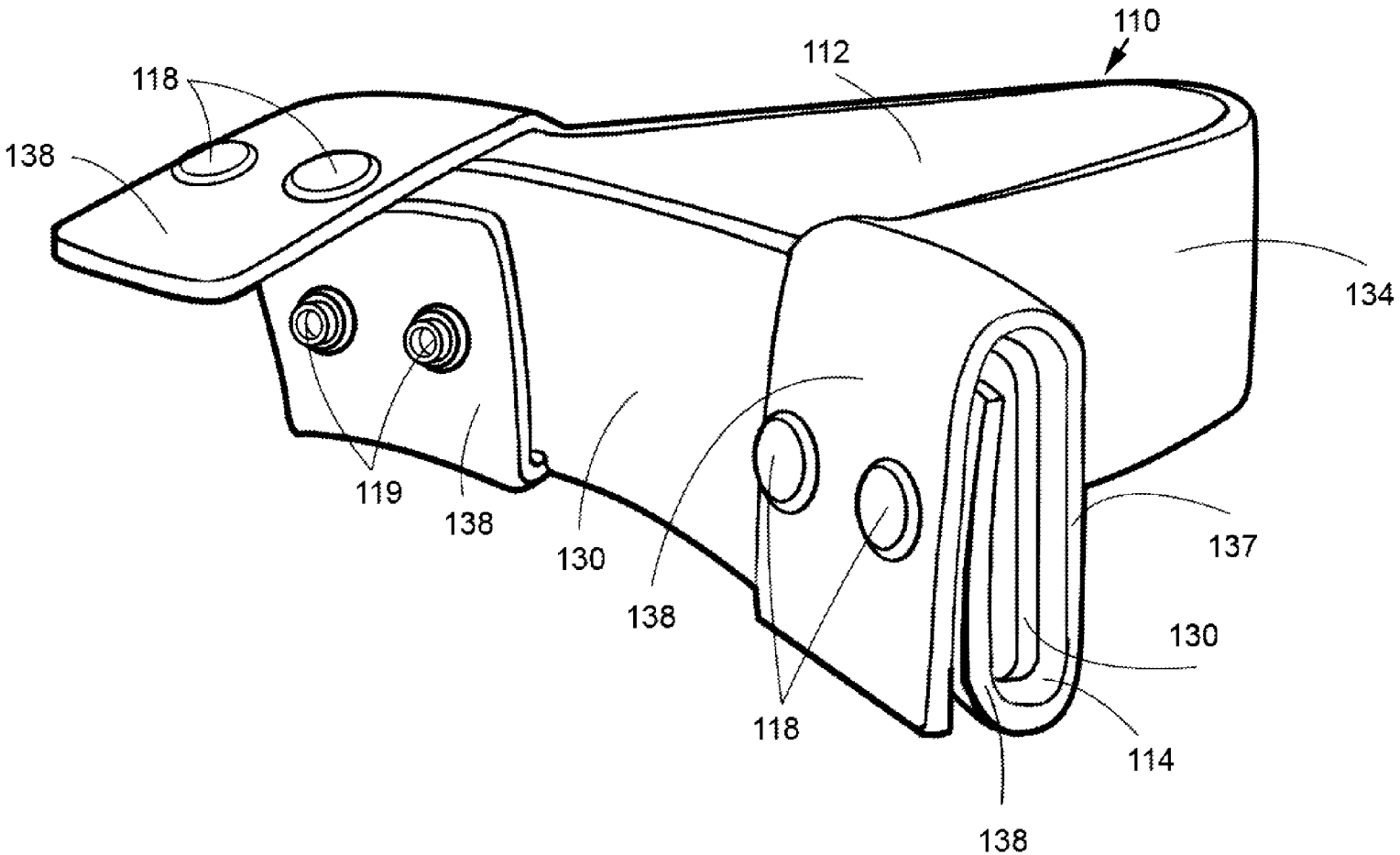
FIG. 7 is a rear perspective view of the first example holster of the present invention.

FIG. 7 illustrates the rear of the first example holster 110 during assembly. The openings 114 are formed by back securing sections 137 and folding back securing sections 138. The female connectors 118 and male connectors 119 are compatible connecting devices such as snaps, clasps, buckles, etc. The female connectors 118 and male connectors 119 illustrated connect the corresponding folding back securing sections 138, and work to hold the holster 110 together.

Figure 8:
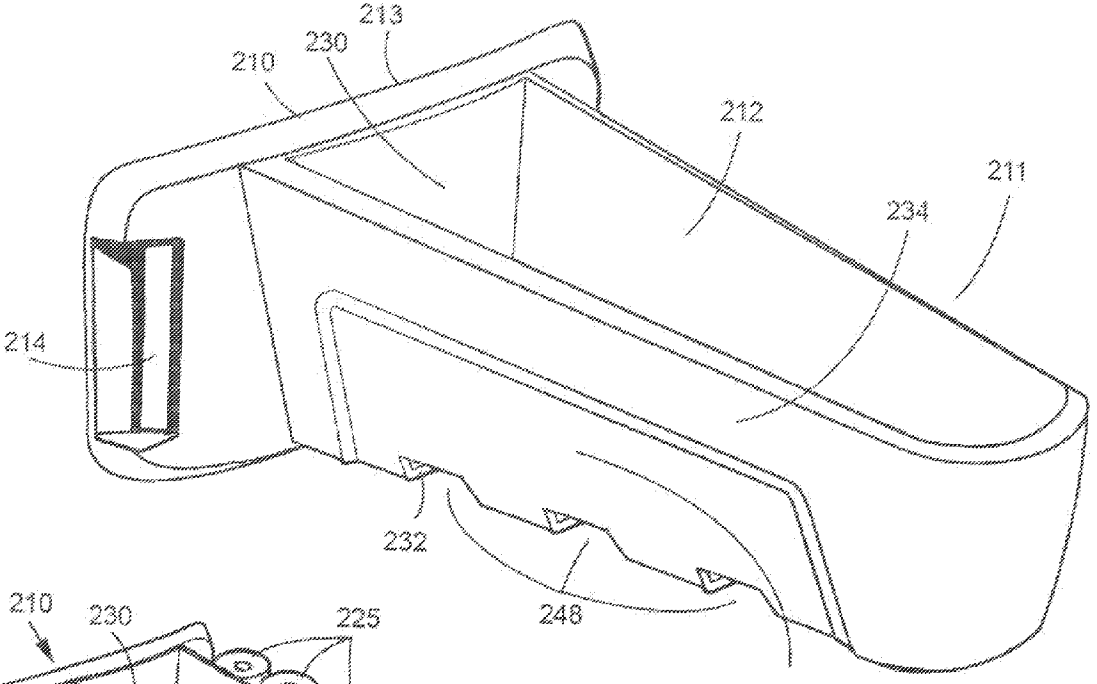
FIG. 8 is a perspective view of a second example holster of the present invention.

FIG. 8 illustrates a second example holster 210. The holster 210 includes a support portion 211 having cavity 212 for holding a butt of a firearm and a base portion 213 for securing to the user, such as to the user's belt. The cavity 212 is formed by a back section 230, bottom section 232 and a side section 234. The back section 230 includes an opening 214 through which a belt can be inserted. The opening 214 is within the back section 230. The back section 230 is approximately on the level of the belt and the holster 210 does not hang below the belt. The base section 232 includes an attachment area 240 onto which an attachment that can hold ammunition can be attached, and openings 248. The openings 248 are formed through the corners of the base section 232 and the side section 234 to prevent the accumulation of water in the cavity 212. Although openings are depicted in FIG. 8, they are not required. The second example holster 210 may be molded as one or more pieces of plastic, rubber, etc.

Figure 9:
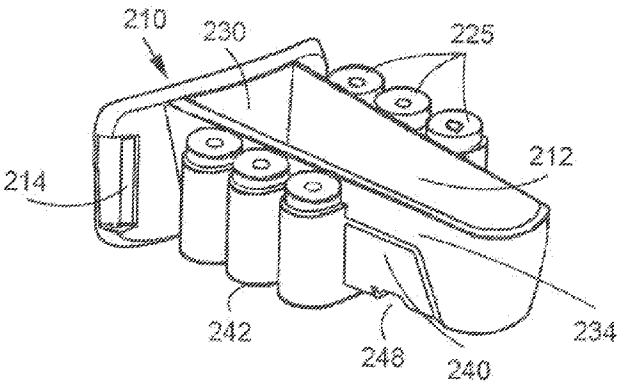
FIG. 9 illustrates the holster of FIG. 8 with ammunition secured.

FIG. 9 illustrates the second example holster 210 with ammunition attached. An ammunition holder 242 holding ammunition 225 is secured to the attachment area 240 or built in as an integral part of the holster. Having ammunition 225 attached to the holster 210 allows for easy access to the ammunition 225 for quick reloading.

Figure 10:
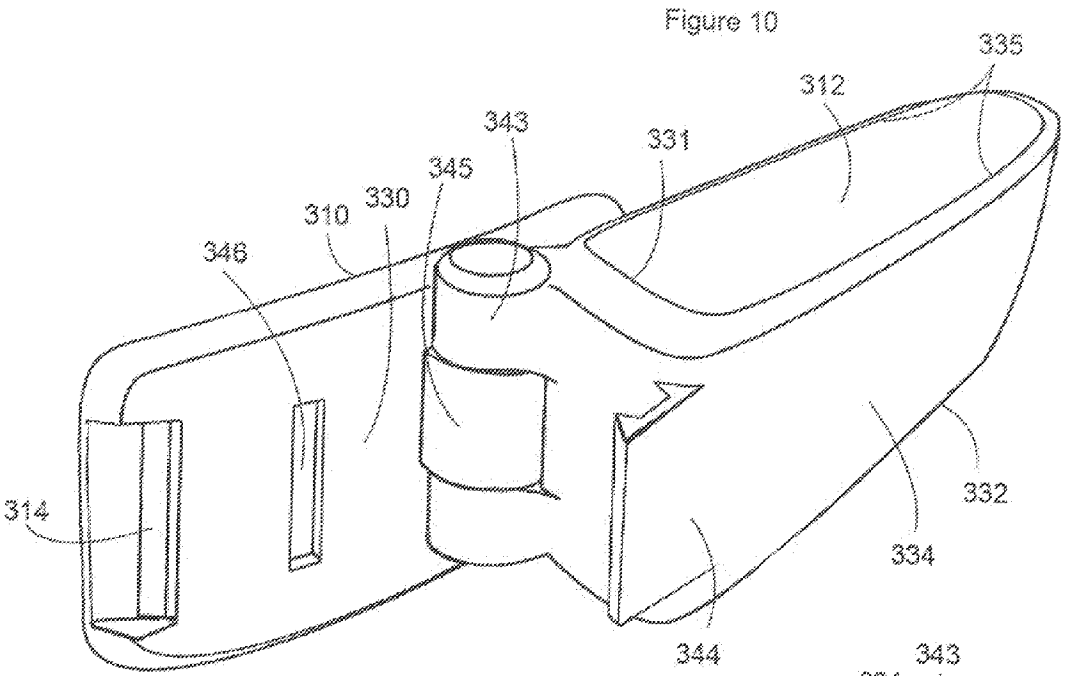
FIG. 10 illustrates a third example holster of the present invention in a collapsed position.
Figure 11:
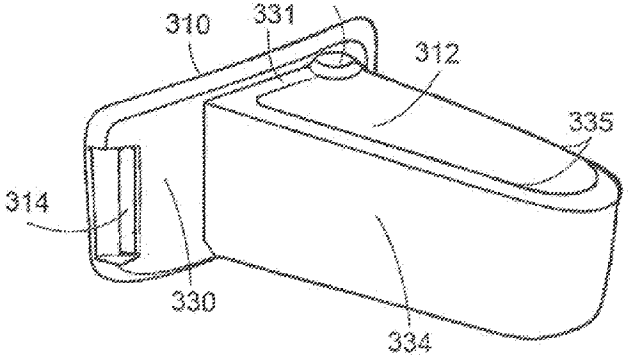
FIG. 11 illustrates the holster of FIG. 10 in an extended position.

FIG. 10 illustrates a third example holster 310 in a collapsed position. The holster 310 includes a base portion 330 and a pivotable support portion 334. The pivotable support portion 334 includes a cavity 312 for holding a butt of a firearm. The cavity 312 is formed by a back wall 331, bottom wall 332 and side walls 335. An opening 314 for inserting a belt is formed through the base portion 330. The base portion 330 is approximately on the level of the belt and the holster 310 does not hang below the belt. The holster 310 includes a receiver hinge portion 343 integrally molded with the support portion 334 and a base hinge portion 345 integrally molded with the base portion 330. The receiver hinge portion 343 is compatible with the base hinge portion 345, such as by a connecting hinge pin, and the hinges are operable to rotate the rotatable support portion 334 relative to the base portion 330. A receiver latch 344 is on the rotatable support portion 334, and a base latch portion 346 is on the base portion 330. The rotatable support portion 334 is able to move between a collapsed position, illustrated, and an extended position as shown in FIG. 11, relative to the base portion 330, where the rotatable support portion 334 may lock to the base portion 330 via the receiver latch 344 and base latch portion 346. While in the collapsed position, the holster 310 is easy to store.

Figure 12:
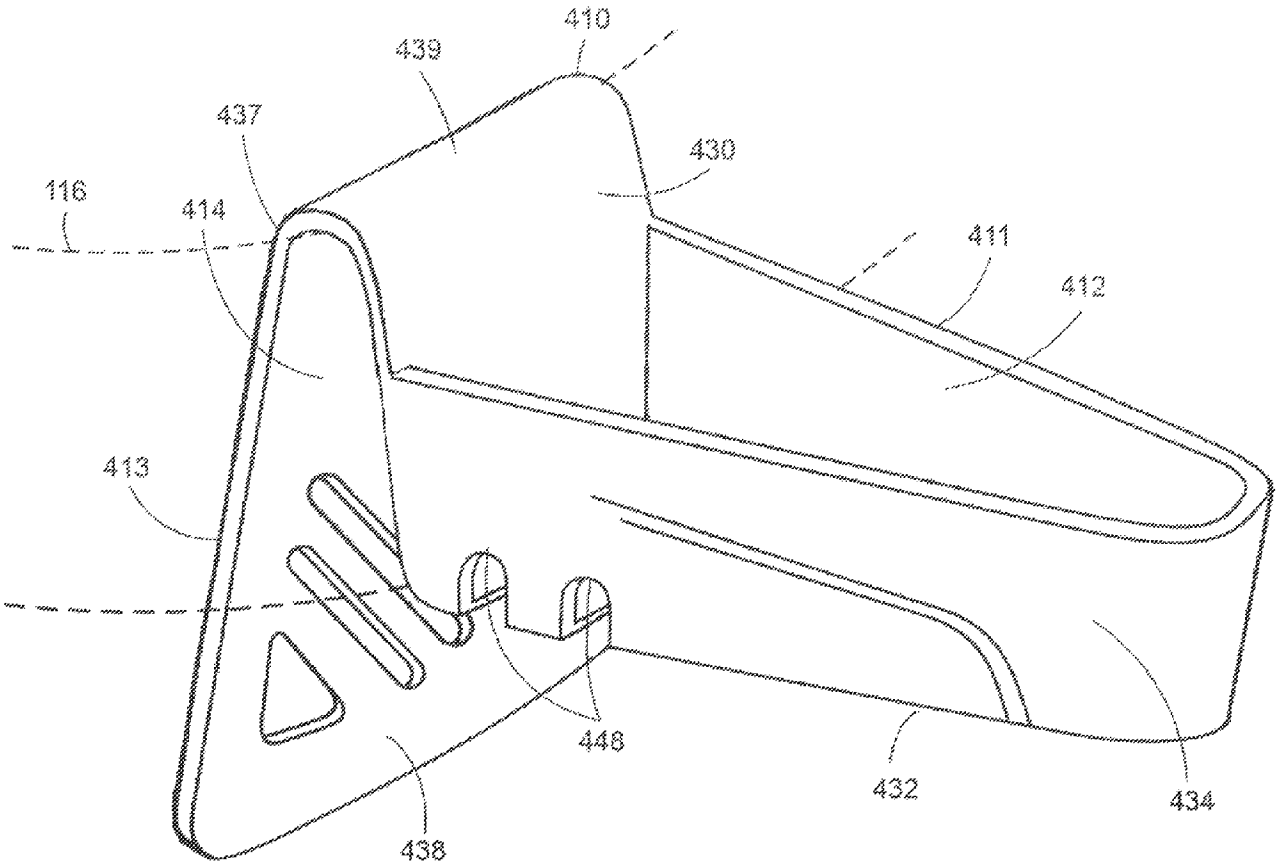
FIG. 12 illustrates a fourth example holster of the present invention.

FIG. 12 illustrates a fourth example holster 410. The holster 410 includes a support portion 411 having a cavity 412 for holding a butt of a firearm and a base portion 413 for securing to a user. The cavity 412 is defined by a back section 430, side sections 434 and a bottom section 432. A back securing section 437 by which the holster 410 may be worn on a belt comprises a rear clip section 438 connected to the back section 430 by a top section 439. An opening 414 is defined between the back section 430 and the back securing section 437. The back section 430 is approximately on the level of the belt 116 and the holster 410 does not hang below the belt. Openings 448 are located in the cavity 412, such as through the corners of the bottom section 432 and side sections 434. The back securing section 437 allows for easy installation and removal of the holster 410, while the openings 448 in the cavity 412 allow for water to drain from the cavity 412. The holster 410 may be integrally molded as a single piece of plastic, or otherwise formed as a single piece of material.

Figure 13:
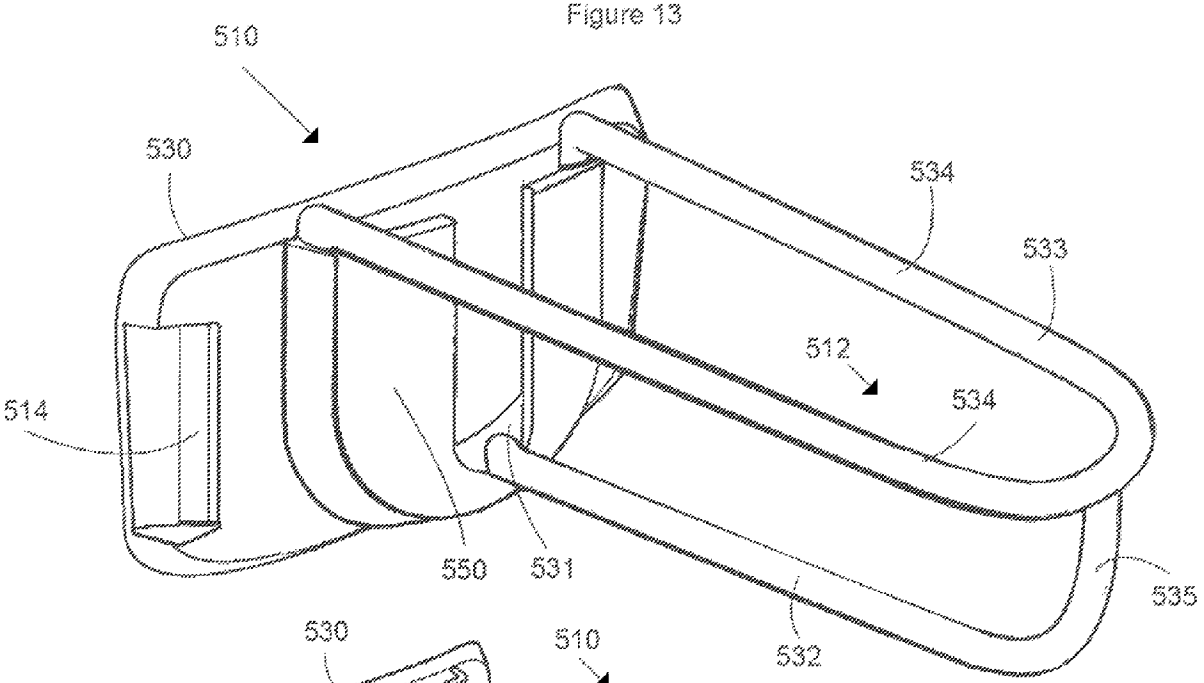
FIG. 13 illustrates a fifth example holster of the present invention in the extended position.

FIG. 13 illustrates a fifth example holster 510. The holster 510 includes a base section 530 and a removable support portion 533. The removable support portion 533 includes a bottom rail 532, spaced-apart top rails 534, a rear rail 531 and a front rail 535. The top rails 534 are spaced-apart above the bottom rail 532 to define a cavity. The front rail 535 extends upward vertically from a forward portion of the bottom rail 532 to a forward portion of the top rails 534. The rear rail 531 is an upwardly open arch or U-shaped member connecting the rearward portion of the bottom rail 532 to rearward portions of the top rails 534. The removable support portion 533 forms a cavity 512 operable to hold a butt of a firearm. An opening 514 through which a belt can be inserted is formed within the base section 530. The base section 530 further includes a pocket 550 for receiving the rear rail 531 of the support portion 533. The base section 530 is approximately on the level of the belt and the holster 510 does not hang below the belt. The removable support portion 533 may be inserted into the base section 530 as shown for use, and the openings in the removable support portion 533 prevent the accumulation of water. Alternatively, the rear rail 531 could be square or other shapes. The base section 530 and the support portion 533 could each be formed of plastic or metal. The framework created by rails 532, 534, and 535 could also be lined with a suitable padded material. In addition, extra rails could also be incorporated for additional support.

Figure 14:
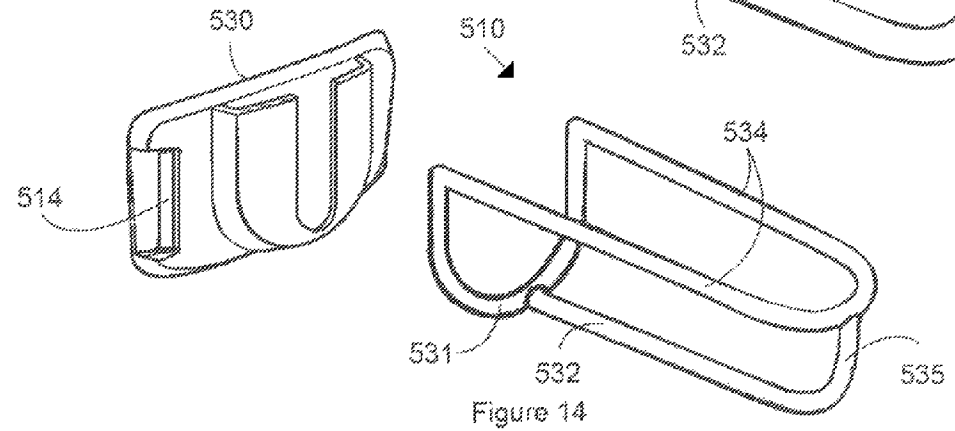
FIG. 14 is an exploded view of the holster of FIG. 13.

FIG. 14 is an exploded view of the holster 510 of FIG. 13. The removable support portion 533 may be removed from the base section 530 as shown for easy storage or cleaning, while the base section 530 may remain on the belt.

Figure 15:
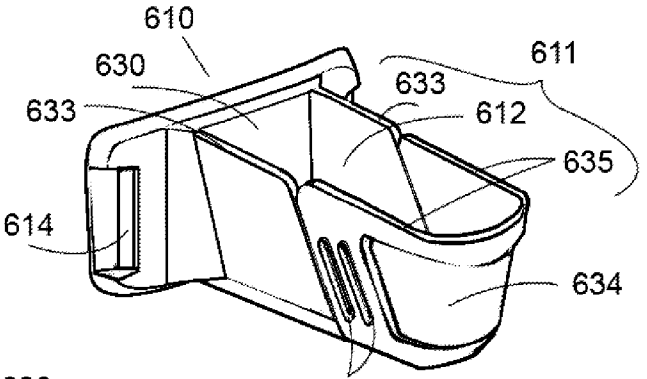
FIG. 15 illustrates a sixth example holster of the present invention in a collapsed position.
Figure 16:
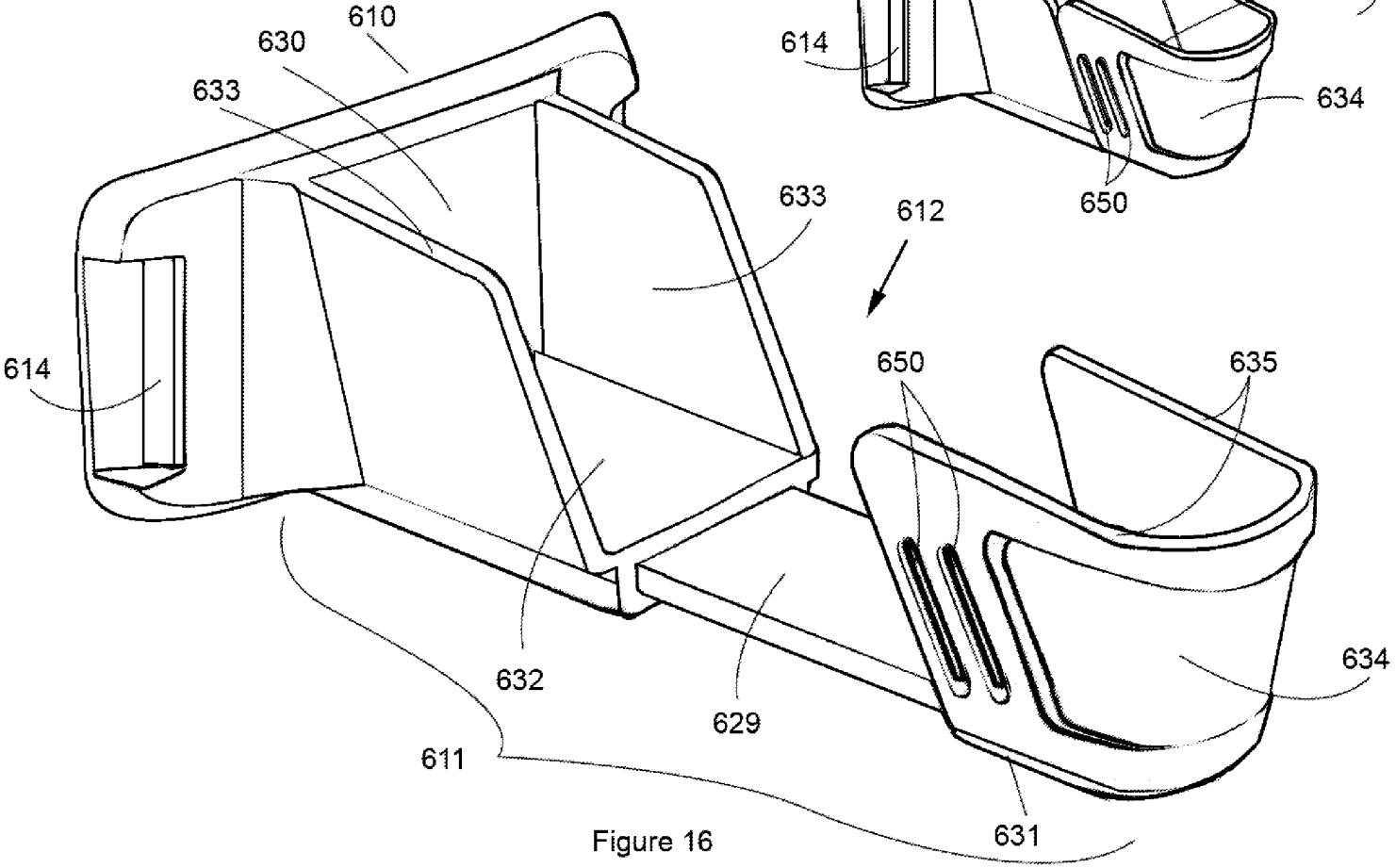
FIG. 16 illustrates the holster of FIG. 15 in an extended position.

FIG. 15 illustrates a sixth example holster 610 in the collapsed position and FIG. 16 illustrates the holster 610 in the extended, use position. Referring to FIGS. 15 and 16, the holster 610 includes a base section 630 for securing to a user and a support portion 611 including an extendable end section 634. The extendable end section 634 can be extended relative to the base section 630. The support portion 611 defines a cavity 612 for holding a butt of a firearm. The cavity 612 is defined by a tab 629, a base bottom section 632 into which the tab 629 is slidable, base side sections 633, an extendable bottom section 631 and extendable side sections 635. The base section 630 includes an opening 614 through which a belt can be inserted. The base section 630 is approximately on the level of the belt and the holster 610 does not hang below the belt. The extendable end section may include grips 650, such as the recesses shown. The extendable end section 634 may be fully collapsed toward the base section 630 as shown in FIG. 15 for easier storage, and the grips 650 on the extendable end section 634 may be used for easier extension and compaction of the extendable end section 634.

Referring to FIG. 16, the extendable end section 634 can be extended relative to the base section 630 and is attached to the base section 630 by the extendable tab 629. The extendable end section 634 may be adjustably extended relative to the base section 630 as shown to accommodate different sizes of firearm butts, and the grips 650 on the extendable end section 634 may be used for easier extension and retraction of the extendable end section 634.

Figure 17:
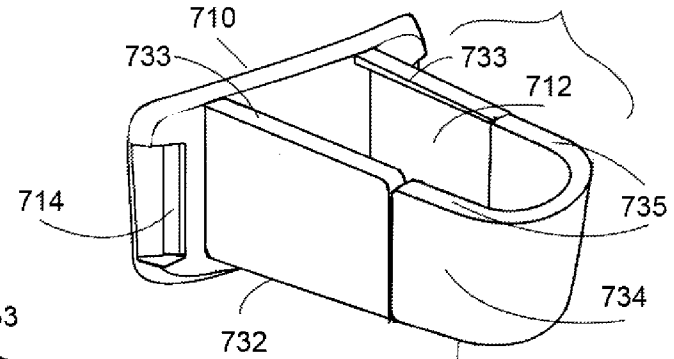
FIG. 17 illustrates a seventh example holster of the present invention in a collapsed position.

FIG. 17 illustrates a seventh example holster 710 in the collapsed position. The holster 710 includes a base portion 730 and a support portion 711 having an extendable end section 734. The extendable end section 734 can be extended relative to the base portion 730 to make the support portion 711 longer or shorter. A cavity 712 for holding a butt of a firearm is formed by a base bottom wall 732, base side walls 733, an extendable bottom wall 731 and extendable side walls 735. An opening 714 through which a belt can be inserted is within the base portion 730. The base portion 730 is approximately on the level of the belt and the holster 710 does not hang below the belt. The extendable end section 734 may be fully collapsed to the base portion 730 as shown for easier storage.

Figure 18:
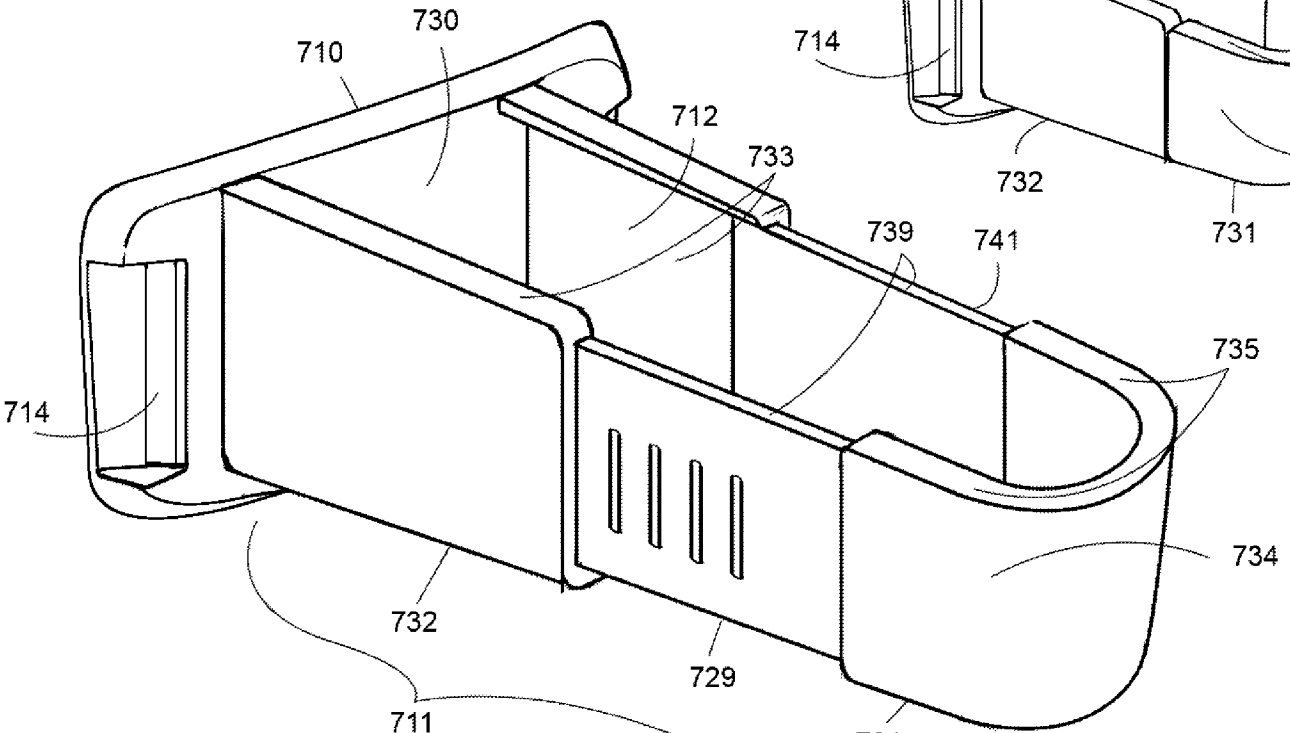
FIG. 18 illustrates the holster of FIG. 17 in an extended position.

FIG. 18 illustrates the seventh example holster 710 in the extended position. The extendable connector section 741 comprises an extendable connector bottom tab 729 with extendable connector side walls 739 extending upwardly therefrom. The extendable connector section 741 is formed integrally with the extendable end section 734. The extendable end section 734 can be extended relative to the base portion 730 and is attached to the base portion 730 by the extendable connector section 741. A cavity 712 for holding a butt of a firearm is formed by a base bottom wall 732, base side walls 733, the extendable connector bottom tab 729, the extendable connector side walls 739, an extendable bottom wall 731 and extendable side walls 735 of extendable end section 734. An opening 714 through which a belt can be inserted is within the base portion 730. The extendable connector bottom tab 729 and the extendable connector side sections 739 slide within the base bottom section 732 and the base side sections 733. The base portion 730 is approximately on the level of the belt and the holster 710 does not hang below the belt. The extendable end section 734 may be adjustably extended relative to the base portion 730 as shown to accommodate different sizes of firearm butts.

Figure 19:
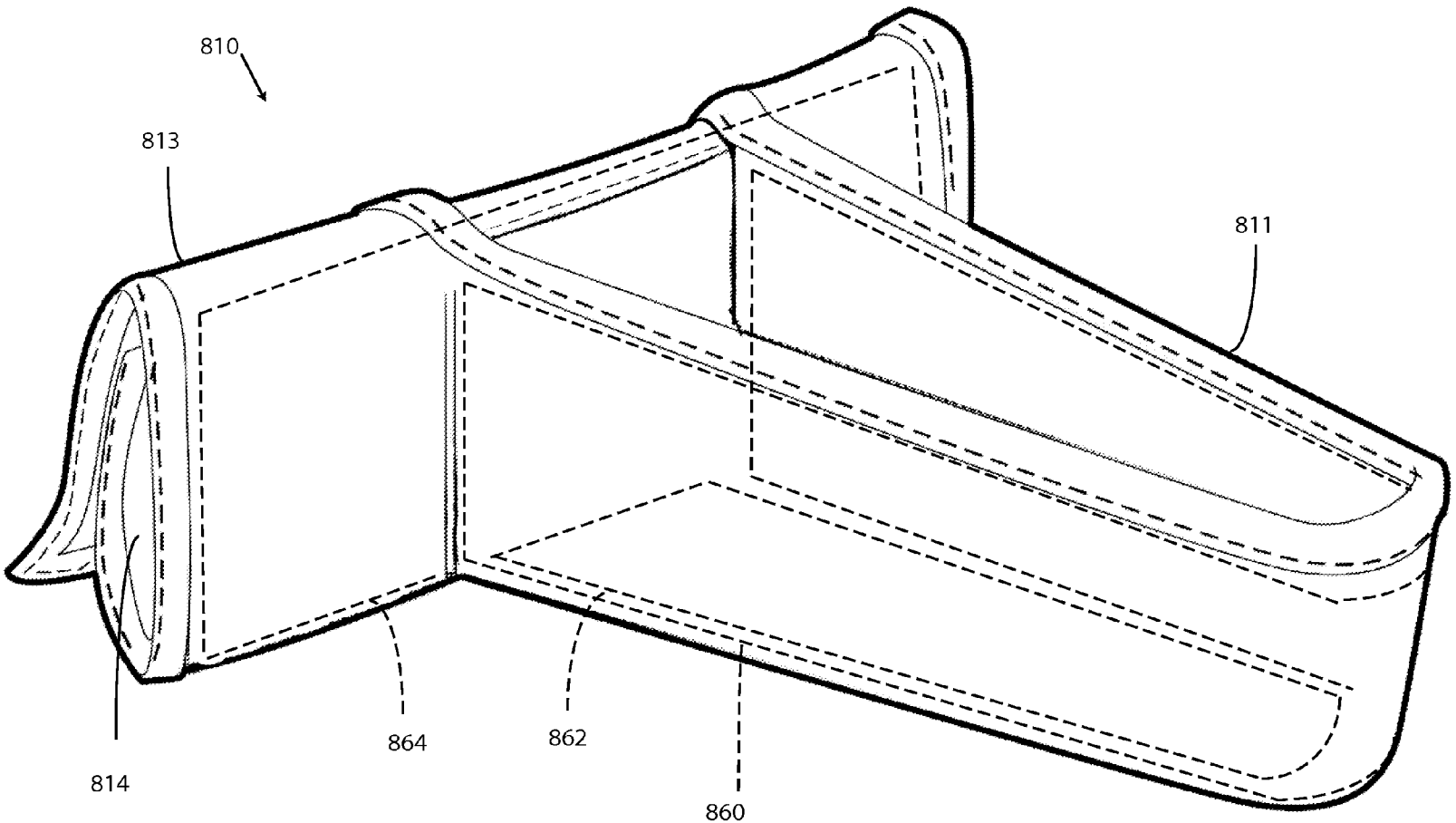
FIG. 19 illustrates an eighth example holster of the present invention.

FIG. 19 illustrates an eighth example holster 810 of the present invention. The holster 810 is similar to the holster 110 of FIGS. 1-7, except as shown and described. The holster 810 includes a base portion 813 having an opening 814 for receiving a belt, and support portion 811 for supporting the gun. The holster 810 is formed from a single piece of flexible material, such as Cordura®. Because the material is not as stiff as the leather, there are rigid inserts sewn into the material, such as a bottom insert 860, a sidewall insert 862 (which could be two sidewall portions integral with a connecting front curved portion, as shown, or as two separate sidewall portions), and a back insert 864. The inserts 860, 862, 864 could be formed of polymer (polypropylene, polyethylene, rubber, etc, fiber composite, or a rigid foam material).

Figure 20:
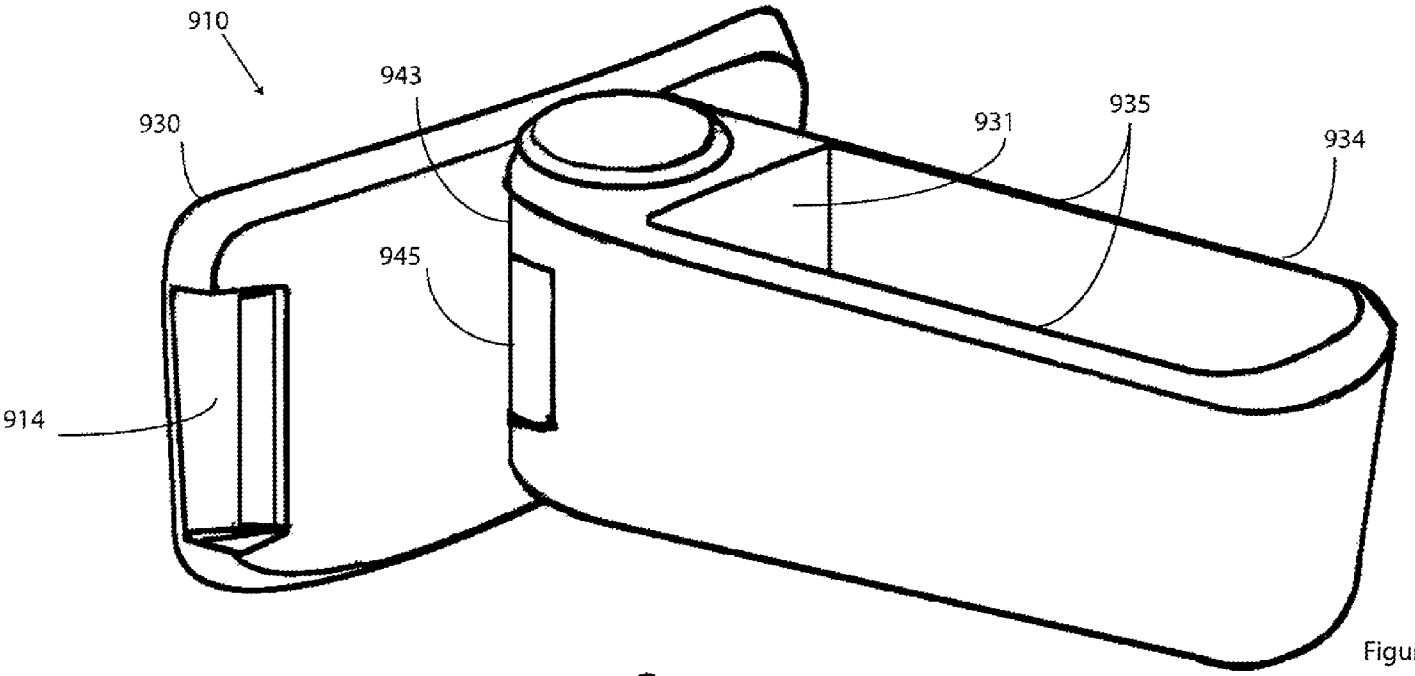
FIG. 20 illustrates a ninth example holster of the present invention in an extended position.

FIG. 20 illustrates a ninth example holster 910 of the present invention in an extended position. The holster 910 includes a base portion 930 having an opening 914 for receiving a belt and pivotably connected to a support portion 934. The support portion 934 includes a bottom wall, side walls 935 and back wall 931. The support portion 934 includes an integral hinge portion 943 pivotably connected to a hinge portion 945 integrally formed with the base portion 930.

Figure 21:
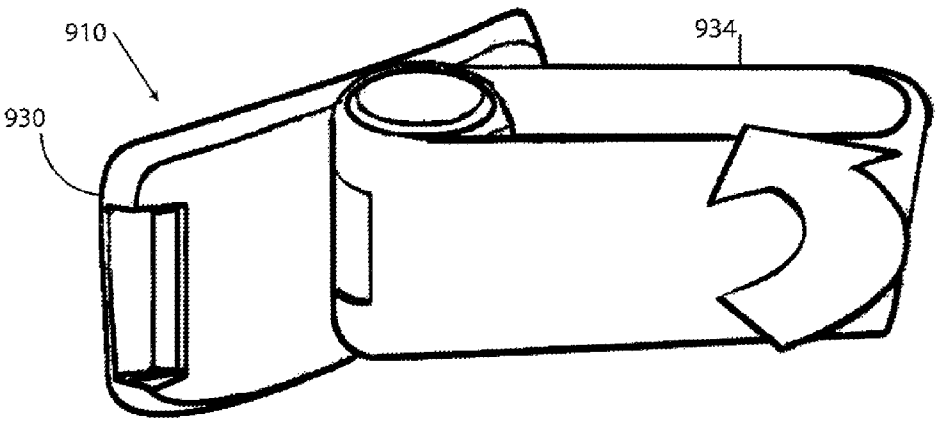
FIG. 21 illustrates the holster of FIG. 20 in a retracted position.

FIG. 21 illustrates the holster 910 of FIG. 20 in a retracted position. As shown, the support portion 934 can be pivoted relative to the base portion 930 either for convenience, comfort or to pivot it to the retracted position when not in use.

Figure 22:
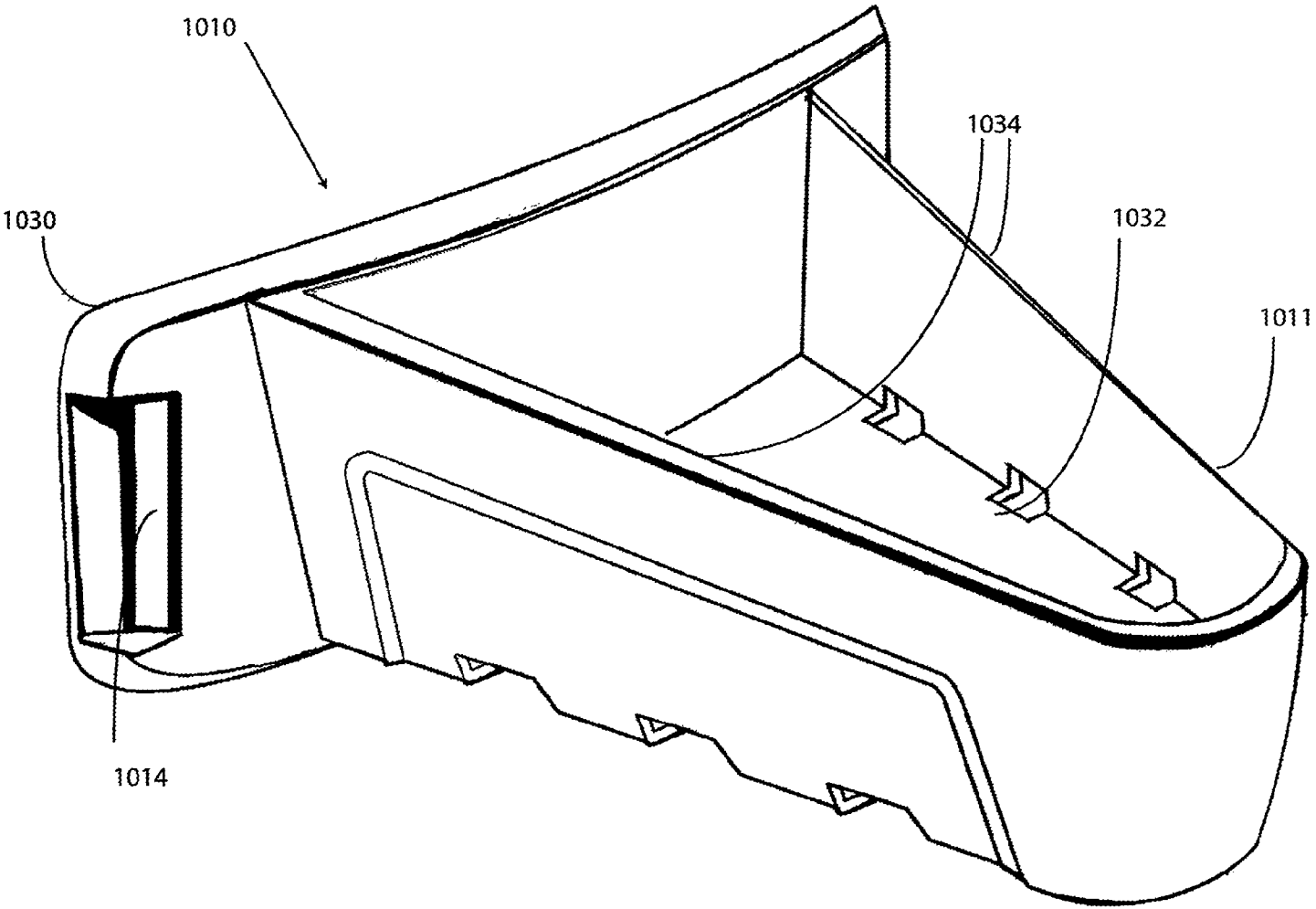
FIG. 22 illustrates a tenth example holster of the present invention.

FIG. 22 illustrates a tenth example holster 1010 of the present invention. The holster 1010 is similar to that described with respect to FIGS. 8 and 9 except as shown or described. The holster 1010 includes a base portion 1030 and a support portion 1011. The base portion 1030 includes an opening 114 for receiving a belt. The support portion 1010 includes a bottom wall 1032 and side walls 1034. In this embodiment, the bottom wall 1032 of the support portion 1010 is generally triangular in shape (as before), but with the triangle having a wider base (i.e. toward the user). With the wider support portion 1011, the user can change the orientation of the gun stock in the support portion 1011 to be more comfortable and more accessible.

Figure 23:
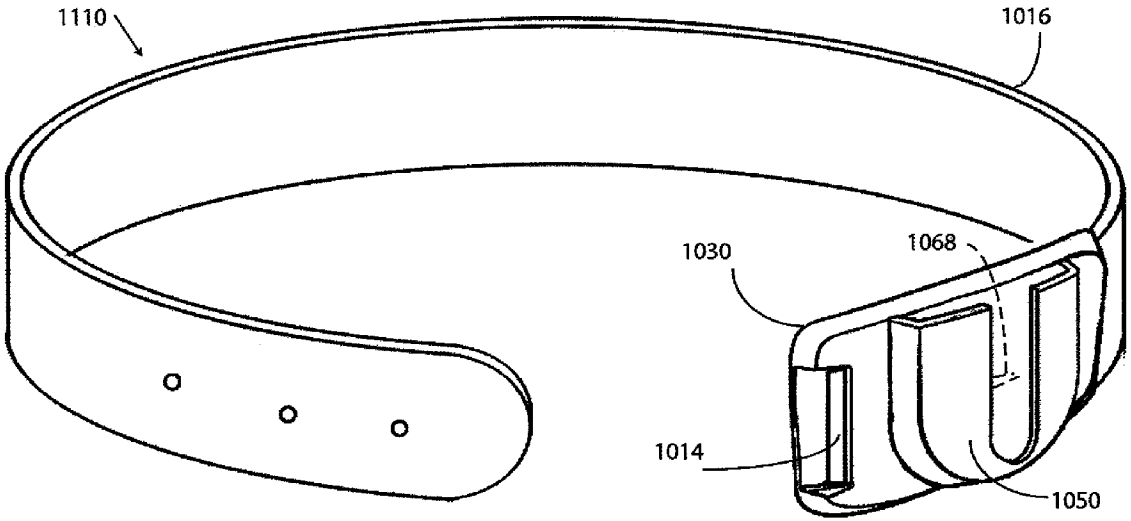
FIG. 23 illustrates an eleventh example holster of the present invention with the support portion removed.
Figure 24:
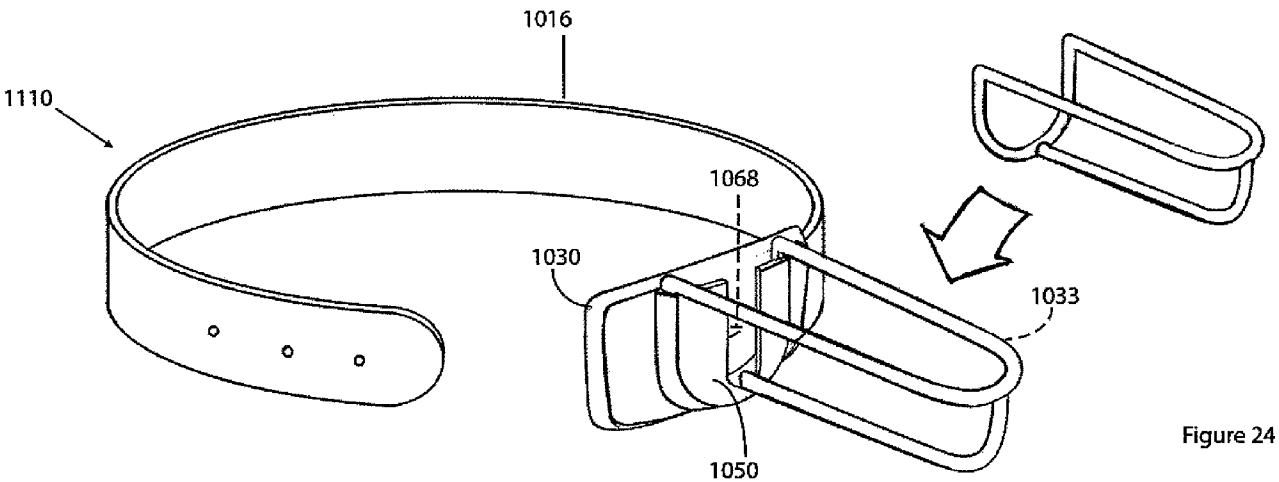
FIG. 24 illustrates the addition of the support portion to the holster of FIG. 23.

FIGS. 23 and 24 illustrate an eleventh example holster 1110 of the present invention. In FIG. 23, the support portion 1033 is removed. The holster 1110 is similar to that of FIGS. 13 and 14, except as shown or described. In this embodiment, the base portion 1030 is connected to the belt 1016 and also serves as the belt buckle. The base portion 1030 includes a hook 1068 on the rear of the base portion 1030, such that the end of the belt 1016 can be inserted into the opening 1014 of the base portion 1030 and hooked on the hook 1068. As before, the base portion 1030 includes the pocket 1050 for receiving the removable support portion 1033, which is the same as before.

Figure 25:
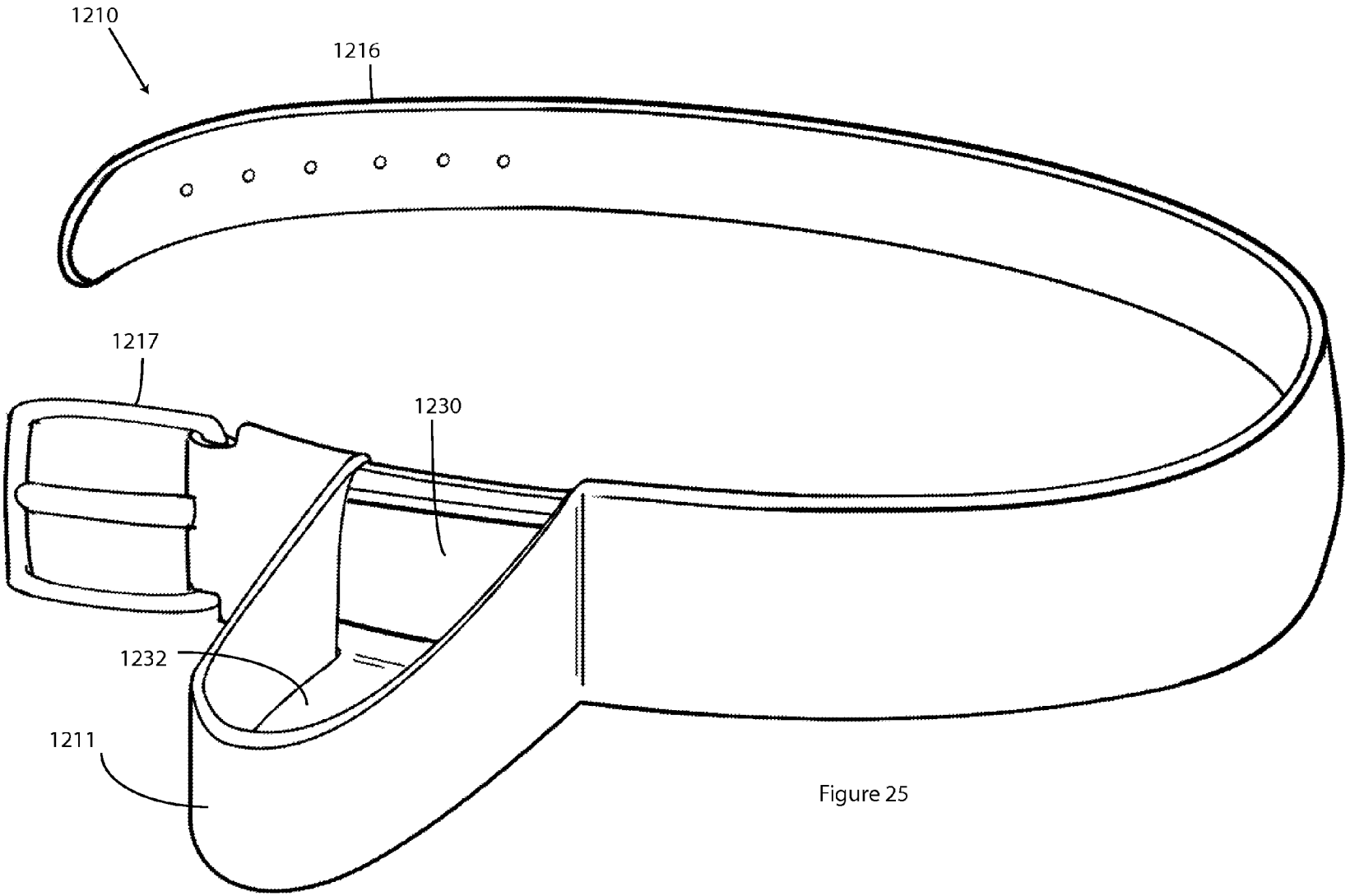
FIG. 25 illustrates a twelfth example holster of the present invention.

FIG. 25 illustrates a twelfth example holster 1210 of the present invention. Generally, the holster 1210 is similar to that of FIGS. 1-7, with the base portion 1230 integrated with a belt 1216. Again, the bottom wall 1232 of the support portion 1211 extends forwardly from a lower edge of the base portion 1230. A buckle 1217 is connected adjacent the support portion 1211 for fastening the belt 1216.

Figure 26:
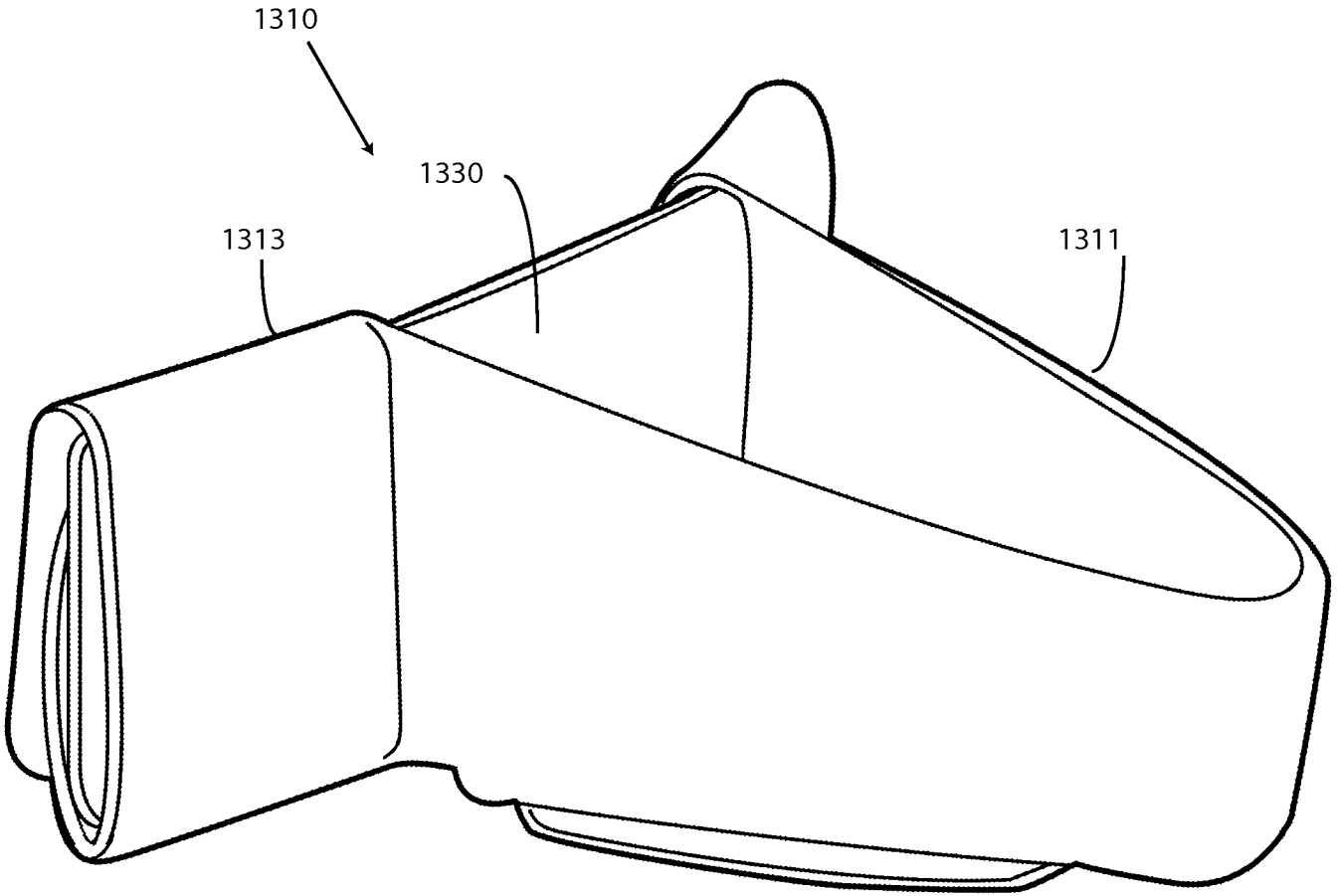
FIG. 26 illustrates a thirteenth example holster of the present invention.
Figure 27:
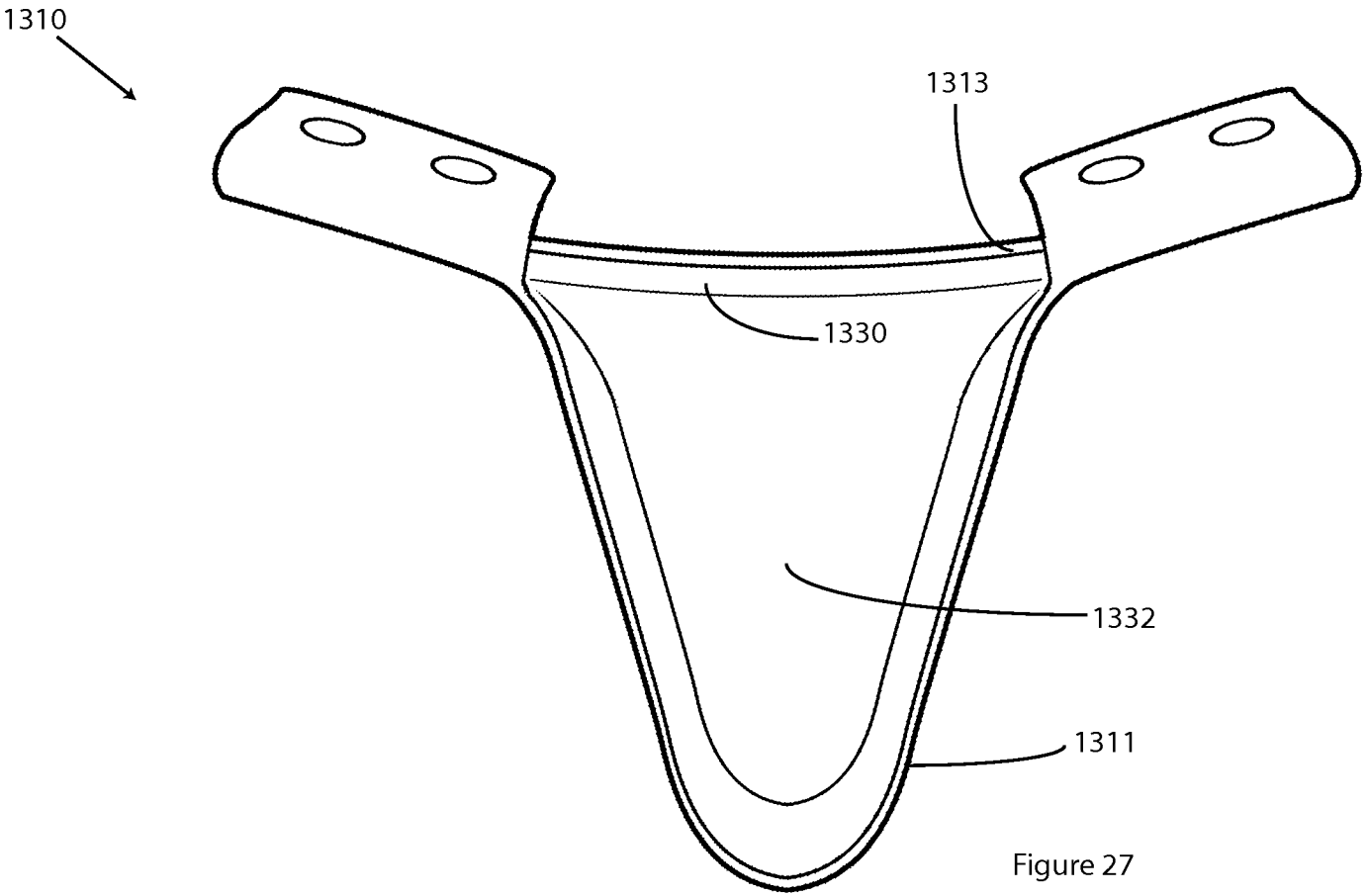
FIG. 27 is a top view of the holster of FIG. 26.

FIGS. 26 and 27 illustrate a thirteenth example holster 1310 of the present invention. The holster 1310 is generally similar to that of FIGS. 1-7 except as shown or described. Generally the holster 1310 includes a base portion 1313 with a back section 1330 and a support portion 1311. As shown in FIG. 27, the support portion 1311 and the bottom wall 1332 is wider toward the user, such that the stock of the gun can be oriented as desired. The holster 1310 could be integrated with a belt as in the design shown in FIG. 25.

The preceding description is exemplary rather than limiting in nature. Variations and modifications to the disclosed examples may become apparent to those skilled in the art that do not necessarily depart from the essence of this disclosure.

What is claimed is:

1. A holster for a long gun comprising: a support portion, a base portion, said support portion defining a cavity with a back, a bottom and a side, said support portion joined to said base portion such that a bottom of said base portion and said bottom of said support portion are coplanar, said base portion defining a back securing section, said back securing section joined to said back, said back securing section defining an opening, whereby a belt can be inserted into said opening for securing the holster to the belt of a wearer while a gun butt rests in said such that the long gun is supported vertically.

2. The holster of claim 1 wherein said cavity is triangularly shaped.

3. The gun holster of claim 1 wherein said support portion is integrally formed with said base portion.

4. The gun holster of claim 1 wherein said bottom is wider adjacent said base portion and tapers away from said base portion.

5. The holster of claim 1 wherein said back securing section comprises a folding section, a first pair of mating connectors, said first pair of mating connectors opposingly positioned on said folding section for overlappingly joining said folding section.

6. The holster of claim 5 wherein said pair of mating connectors comprises a male connector and a female connector.

7. The gun holster of claim 5 wherein said back securing section comprises a second pair of mating connectors, said second pair of mating connectors opposingly positioned on said folding section for overlappingly joining said folding section.

8. A holster for a long gun in combination with a belt, the belt comprising a strap, a buckle, said strap connected to said buckle;

the holster comprising a support portion, a base portion, said support portion defining a cavity with a back, a bottom and a side, said support portion joined to said base portion such that a bottom of said base portion and said bottom of said support portion are coplanar, said base portion defining a back securing section, said back securing section joined to said back, said back securing section defining an opening, said belt positioned in said opening, whereby a gun butt rests in said cavity such that the long gun is supported vertically.

9. The gun holster of claim 8 wherein said holster is formed from leather.

10. The gun holster of claim 8 wherein said back securing section comprises a folding section, a first pair of mating connectors, said first pair of mating connectors opposingly positioned on said folding section for overlappingly joining said folding section.

11. The gun holster of claim 10 wherein said back securing section comprises a second pair of mating connectors, said second pair of mating connectors opposingly positioned on said folding section for overlappingly joining said folding section.

12. The holster of claim 11 wherein said first and second pairs of mating connectors each comprises a male connector and a female connector.

13. The holster of claim 11 wherein said cavity is triangularly shaped.

14. The gun holster of claim 13 wherein said support portion is integrally formed with said base portion.

15. The gun holster of claim 13 wherein said bottom is wider adjacent said base portion and tapers away from said base portion.

16. A gun holster in combination with a long gun and a belt, said combination comprising:

the belt comprising a strap, a buckle, said strap connected to said buckle;

the long gun defining a butt;

the holster comprising a support portion, a base portion, said support portion defining a triangular cavity with a back, a bottom and a side, said support portion joined to said base portion such that a bottom of said base portion and said bottom of said support portion are coplanar, said bottom being wider adjacent said base portion and tapering away from said base portion, said base portion defining a back securing section, said back securing section joined to said back, said back securing section defining a pair of openings, said belt positioned in said pair of openings in front of said back but behind said back securing section, said back securing section comprises a folding section, a first pair of mating connectors, a second pair of mating connectors, each of said pairs of mating connectors further comprising a male connector and a female connector, said pairs of mating connectors opposingly positioned on said folding section for overlappingly joining said folding section, wherein said butt is positioned within said triangular cavity and said butt weight is distributed by said belt.

* * * * *